US006685498B1

(12) United States Patent
Jones et al.

(10) Patent No.: US 6,685,498 B1
(45) Date of Patent: Feb. 3, 2004

(54) LOGIC ANALYZER TESTING METHOD AND CONFIGURATION AND INTERFACE ASSEMBLY FOR USE THEREWITH

(76) Inventors: Ronald Jones, 9 Forest Brook Dr., Barrington, NH (US) 03825; Scott Scheeler, 9 Jennie La., Eliot, ME (US) 03903; Richard Graham, 186 Island Pond Rd., Derry, NH (US) 03038

( * ) Notice: Subject to any disclaimer, the term of this patent is extended or adjusted under 35 U.S.C. 154(b) by 0 days.

(21) Appl. No.: 10/259,206

(22) Filed: Sep. 27, 2002

(51) Int. Cl.[7] ..... H01R 11/18
(52) U.S. Cl. ..... 439/482; 324/761; 324/754
(58) Field of Search ..... 439/482, 587, 439/444; 324/761, 754

(56) References Cited

U.S. PATENT DOCUMENTS 5,162,728 A 11/1992 Huppenthal
5,227,718 A 7/1993 Stowers et al.
5,637,012 A * 6/1997 Ott ..... 439/482
5,812,563 A 9/1998 Hedlund et al.
5,945,837 A 8/1999 Fredrickson
6,092,224 A 7/2000 LeBlanc et al.
6,137,296 A * 10/2000 Yoon et al. ..... 324/754

* cited by examiner

*Primary Examiner*—Dean A. Reichard
*Assistant Examiner*—Jinhee Lee
(74) *Attorney, Agent, or Firm*—Devine, Millimet & Branch; Kevin J. Carroll

(57) ABSTRACT

The logic analyzer interface assembly connects to a unit under test (UUT). The interface assembly includes an interface board having interface contact points matching the pattern of the UUT contact points. The interface board is mounted to a transfer interface including a probe plate and multiple spring loaded probes extending through the probe plate. The probes contact the UUT contact points at one end and the interface contact points at the other end. When assembled, the UUT and interface assembly form a sandwiched testing assembly that can be inserted into a chassis to aid in approaching an "at speed" observation opportunity.

9 Claims, 11 Drawing Sheets

LOGIC ANALYZER TESTING METHOD AND CONFIGURATION AND INTERFACE ASSEMBLY FOR USE THEREWITH

TECHNICAL FIELD

The present invention relates to electronic testing and more particularly, to a testing configuration and an interface assembly for use with a logic analyzer.

BACKGROUND INFORMATION

Printed circuit boards (PCBs) and the electronic components on the PCBs are tested to detect faults and to ensure proper operation of the PCBs. Greater demands for speed and bandwidth in the computer and telecommunications industries have resulted in PCBs with higher densities of electronic components and signals. A motherboard used in a router or switch, for example, includes a large number of application specific integrated circuit (ASIC) devices. As a result of the smaller size and increased number of components on a single PCB, proper testing of the PCB and the electronic components has become more critical and more difficult.

One way of testing PCBs with electronic components is using a logic analyzer system. The logic analyzer system connects to signal points on the PCB and monitors the signals executed by the electronic components on the PCB. Engineers and technicians can use the logic analyzer system to analyze the signal patterns and detect faults in the electronic components. Testing using a logic analyzer is preferably conducted at or near the operating speed of the PCB to approach an "at speed" observation opportunity for the signals. To approach an "at speed" observation, testing is typically conducted under operating conditions with the PCB located in an assembled system (e.g., in a chassis).

The previous approach to conducting this type of "at speed" test using a logic analyzer system was to solder individual wires to the PCB signal points and transfer those wires to the analyzer connectors. One of the drawbacks of this approach is having to connect the individual wires to a large number of test points that are difficult to access on a dense PCB. When testing multiple PCBs, the changeover between PCBs is time consuming and tedious.

One technique for testing a PCB with a large number of test points uses a test fixture including an array of probes, often referred to as a "bed of nails." In the conventional "bed of nails" test fixture, the probes, at one end, contact test points on the PCB. At the opposite end, the probes are connected to the test equipment using single point wiring. Thus, the conventional "bed of nails" test fixture still requires a significant amount of wiring when used to test PCBs with a large number of test points. Traditional "bed of nails" test fixtures are associated with, and targeted towards, industry standard platforms for Manufacturing Defect Analyzer (MDA) and In-Circuit testers. These testers and fixtures generally are not suited for "at speed" implementations, for example, because of problems with signal integrity, and would not be compatible through form and fit to a custom chassis interface.

Accordingly, there is a need for a testing configuration and a logic analyzer interface assembly that speeds the test process and aids in approaching "at speed" testing of a PCB and that allows a quick changeover between multiple PCBs having a large number of test points.

SUMMARY

In accordance with one aspect of the present invention, a logic analyzer interface assembly is used with a unit under test (UUT,) having a plurality of UUT contact points in a predefined pattern. The interface assembly comprises an interface board having a plurality of interface contact points on a primary side arranged to match the predefined pattern of the UUT contact points. A plurality of analyzer connectors on a secondary side of the interface board are electrically connected to the contact points. The assembly also comprises a transfer interface including at least one probe plate and a plurality of probes extending through and floating freely in the probe plate. Each of the probes includes a barrel and a single spring loaded plunger extending from the barrel. The plunger of each of the probes contacts the UUT contact points and the barrel of each of the probes contacts the interface contact points on the interface board. At least one probe retention plate is positioned over at least one side of the probe plate for retaining the probes in the probe plate.

In accordance with another aspect of the present invention, a logic analyzer testing configuration comprises a sandwiched testing assembly and a chassis for receiving the testing assembly. The sandwiched testing assembly is dimensioned to fit into a rack in the chassis and the UUT is allowed to mate with back panel connections of the chassis as in a normal operating configuration such that testing of the UUT is conducted within the chassis. The sandwiched testing assembly comprises the unit under test (UUT), the interface board, and the transfer interface sandwiched between the UUT and the interface board. The transfer interface includes at least one probe plate and a plurality of probes extending through the probe plate. Each of the probes contacts one of the UUT contact points on the UUT and one of the interface contact points on the interface board. Analyzer cables are connected to the analyzer connectors on the interface board, and media cables are connected to the UUT.

According to a further aspect of the present invention, a method of interfacing a unit under test (UUT) to a logic analyzer comprises providing a unit under test (UUT) having a plurality of electronic components and a plurality of UUT contact points in a predefined pattern and providing a logic analyzer interface assembly. The UUT is mounted to the logic analyzer interface assembly to form a sandwiched testing assembly such that each of the probes contacts one of the UUT contact points on the UUT corresponding to the interface contact points on the interface board. The sandwiched testing assembly is inserted into a rack in a chassis, UUT cables are connected to the UUT, and logic analyzer cables are connected to the logic analyzer interface assembly.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
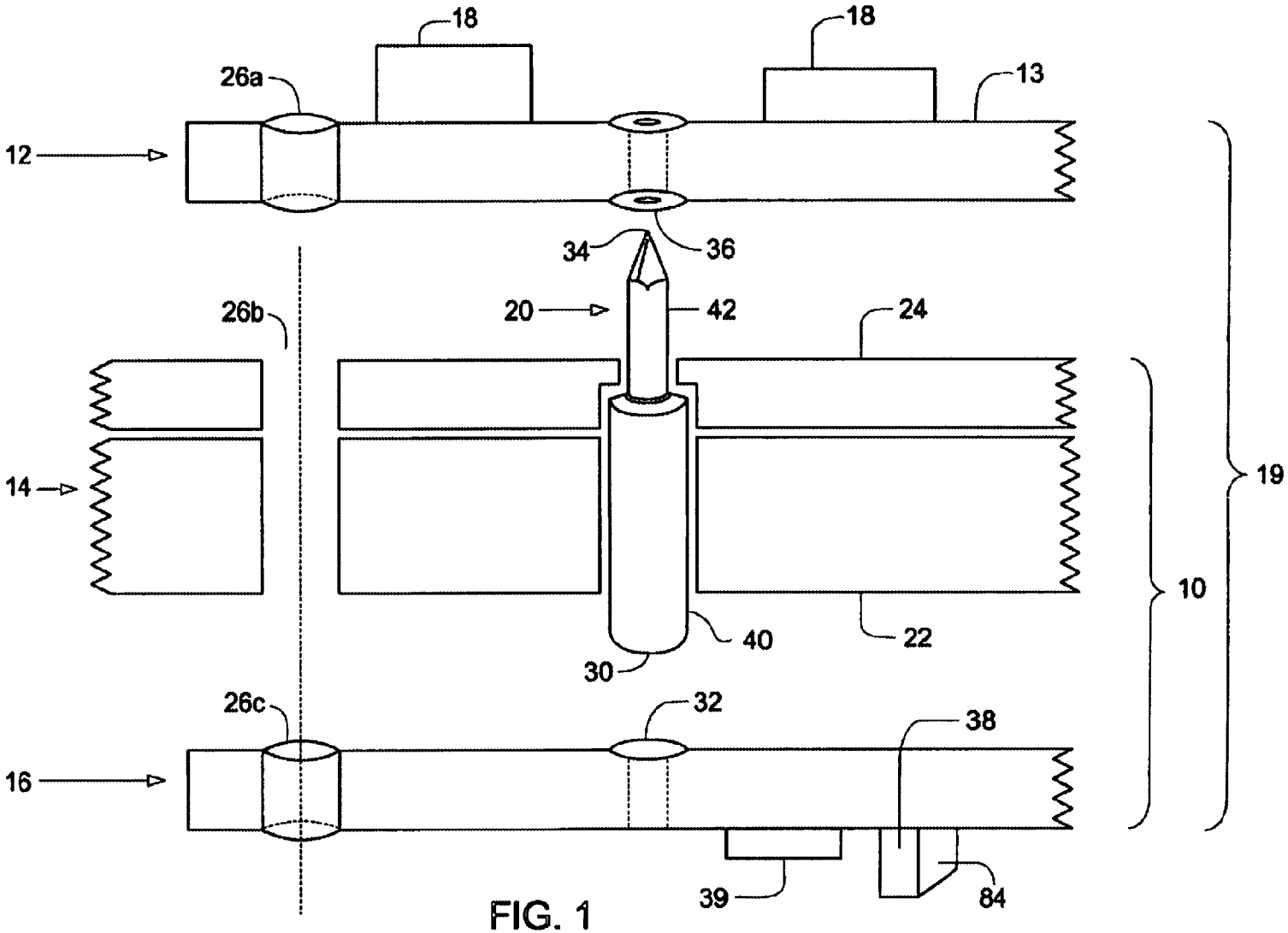
FIG. 1 is an exploded schematic side view of a sandwiched testing assembly, according to one embodiment of the present invention.

Referring to FIG. 1, a logic analyzer interface assembly 10 is shown with a unit under test (UUT) 12. In the exemplary embodiment, the UUT 12 is a printed circuit board (PCB) 13 having a plurality of electronic components 18. The logic analyzer interface assembly 10 interfaces the UUT 12 to a logic analyzer (not shown) in a way that aids in approaching an "at speed" observation opportunity for the signals pertaining to the electronic components 18. Although the interface assembly 10 is used to test multiple components 18 on the UUT 12, an interface assembly can also be designed in accordance with the present invention for testing individual components.

In general, the logic analyzer interface assembly 10 includes a transfer interface 14 coupled to an interface board 16. The transfer interface 14 contacts the UUT 12 and the interface board 16 connects to the logic analyzer. The transfer interface 14 includes an array of probes 20 (shown in FIG. 1 with only one probe 20) extending through a probe plate 22. Each probe 20 preferably floats freely .in a probe hole formed in the probe plate 22, and at least one probe retention plate 24 retains each probe 20 on at least one side of the probe plate 22.

Figures 2, 3:
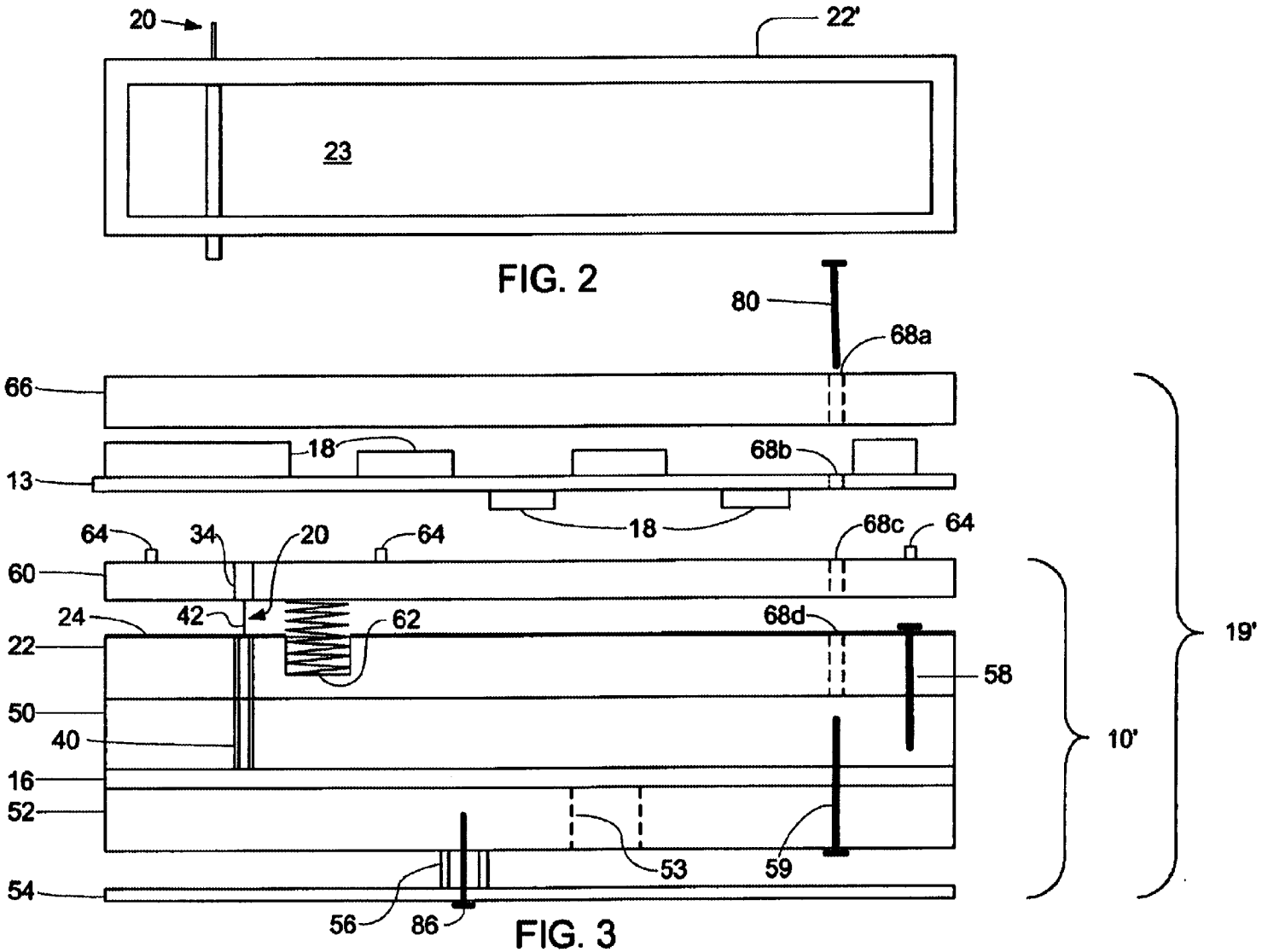
FIG. 2 is a cross-sectional schematic view of a transfer interface, according to another embodiment of the present invention.
FIG. 3 is a partially exploded schematic side view of a sandwiched testing assembly, according to another embodiment of the present invention.

Although the probe plate 22 is shown as a single solid piece in FIG. 1, another embodiment of the probe plate 22' includes one or more hollowed out regions 23, for example, as shown in FIG. 2. The hollowed out region(s) 23 in the probe plate 22 reduce the weight of the probe plate 22 without sacrificing the desired rigidity or stiffness. According to one example, the probe plate 22 can be made of a fiberglass material (e.g., G-10) similar to that used in a PCB and the probe retention plate 24 can be made of a polyester film such as the type sold under the name MYLAR®. One advantage of this type of film is that it can be drilled, matching the probe pattern for the field, with a precision size diameter slightly larger than the plunger 42 and smaller than the barrel 40, thereby retaining the probe 20 in the transfer interface 14.

The UUT 12, transfer interface 14 and interface board 16 include respective aligned tooling holes 26*a*, 26*b*, 26*c* for receiving tooling pins (not shown) for aligning the UUT 12, transfer interface 14 and interface board 16 during assembly.. When assembled, the UUT 12, transfer interface 14 and interface board 16 form a sandwiched testing assembly 19 dimensioned to fit into a chassis (not shown in FIG. 1), as described in greater detail below. In the sandwiched testing assembly 19, a base end 30 of each probe 20 contacts an interface contact point 32 on the primary side of the interface board 16 and a tip 34 of each probe 20 contacts a UUT contact point 36 on the UUT 12.

The interface board 16 is preferably routed such that the pattern of interface contact points 32 mimics the pattern of UUT contact points 36 on the UUT 12. The interface contact points 32 are preferably made of a conductive material that is less susceptible to oxidation, such as gold, platinum or silver. In one embodiment, the interface contact points 32 are made of gold over nickel. The interface board 16 includes conductive paths electrically connecting the interface contact points 32 to connection points 38 on the secondary side of the interface board 16. The connection points 38 connect the interface board 16 to the logic analyzer (not shown), for example, by way of analyzer connectors 84 mounted on the secondary side of the interface board 16. One embodiment of the analyzer connectors 84 is the type known as MICTOR connectors. The UUT contact points 36 are electrically connected to the electronic components 18 on the UT 12.

Figure 1A:
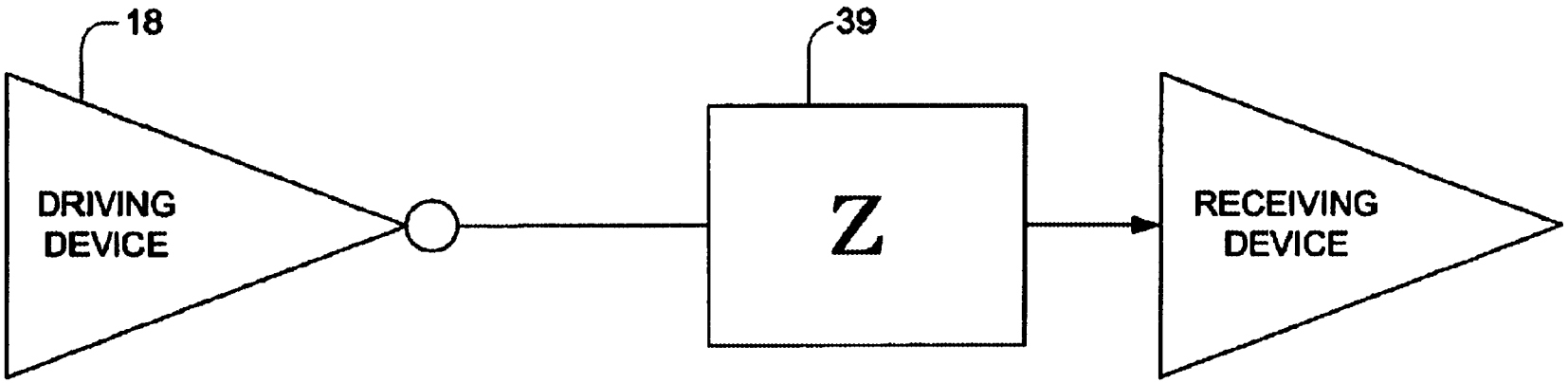
FIG. 1A is a schematic diagram of a signal termination technique that can be used in the testing assembly, according to one embodiment of the present invention.

To ensure signal quality, active and passive signal termination techniques may be used, such as known transmission line termination techniques used in high speed circuits. The preferable termination techniques depend on the signal type (i.e., clock, input/output, or power) and signal direction (i.e., input only, bi-directional, output only). One example of a signal termination technique is implemented using an electronic component 39, such as an impedance matching component, placed as close as possible to the connection points 38 on the interface board. According to one embodiment, a directional path, in-line termination is shown schematically in FIG. 1A. The components 18 act as the driving device and the logic analyzer acts as the receiving device. The impedance matching component 39 limits the amount of signal reflection returning to the source or driving device. The signal termination may be accomplished by generally accepted methods such as series termination, parallel termination, or ac termination.

Each probe 20 is preferably a single-ended probe including a barrel 40 having the base end 30 and a spring-load plunger 42 having the tip 34. The single-ended probe provides a higher spring force and more reliable contact against the UUT contact points 36 than other types of probes. The tip 34 is preferably a single point tip, such as a spear tip, to provide better force per contact and to allow more probes in a smaller space. The higher force per contact and sharp tip 34 help to cut through oxidation or other contamination on the UUT contact points 36. Having the base end 30 (as opposed to another plunger tip) contact the interface contact points 32 is sufficient because oxidation is less likely to occur on the interface contact points 32. According to one embodiment of the probe 20, the diameter of the plunger 42 is about 0.020 in. and the spring loaded plunger 42 provides an optimum force of about 4.0 oz at about ⅔ travel. In one embodiment, each probe 20 is gold plated, although other conductive materials are contemplated. Probes that can be used with the present invention are available from Everett Charles Technologies.

To ensure signal quality in one preferred embodiment, the positioning of probes 20 along the electrical net of the UUT 12 can be designed such that the signal along the electrical net is not influenced by the connection of the probe 20 or the associated connection to the interface board 16. This positioning can depend on the type and direction of the signal. For an input only or an output only signal, for example, the probe 20 is preferably positioned on the electrical net at the receiving end of the signal. For a bi-directional signal, the probe 20 can be positioned anywhere on the electrical net.

Another embodiment of the logic analyzer interface assembly 10' is shown in greater detail in FIG. 3. This embodiment of the interface assembly 10' further includes a first stiffener plate 50 between the probe plate 22 and the primary side of the interface board 16 and a second stiffener plate 52 on the secondary side of the interface board 16. The stiffener plates 50, 52 can be made of a fiberglass material such as G-10. A rail guide plate 54 is mounted to the second stiffener plate 52 with standoffs 56. In one embodiment, the probe plate 22 is about 0.562 in. thick, the first stiffener plate 50 is about 0.438 in. thick, the interface board 16 is about 0.110 in. thick, the second stiffener plate 52 is about 0.500 in. thick, and the rail guide plate 54 is about 0.093 in. thick.

The first stiffener plate 50 includes probe holes aligning with the probe holes in the probe plate 22 such that the barrel 40 of each probe 20 extends through the aligned probe holes. Although the probe plate 22 and the first stiffener plate 50 can be formed as a single plate, the probe holes can be drilled more accurately through separate plates having smaller thicknesses. The second stiffener plate 52 includes open regions 53 that receive the analyzer connectors 84 (shown in FIG. 8) mounted on the secondary side of the interface board 16. The second stiffener plate 52 helps maintain the co-planarity of the interface board 16. In this embodiment, fasteners 58 (e.g., screws) hold the probe plate 22 and first stiffener plate 50 together and fasteners 59 (e.g., screws) hold the second stiffener plate 52, the interface board 16 and the first stiffener plate 50 together. Other fastener configurations are also contemplated.

This embodiment of the logic analyzer interface assembly 10' further includes a stripper plate 60 located on the other side of the probe plate 22 with one or more springs 62 or other biasing elements positioned between the stripper plate 60 and the probe plate 22. The stripper plate 60 preferably includes standoffs 64 for contacting the PCB 13 and probe holes for receiving the plunger 42 of each probe 20. The PCB 13 is positioned between the stripper plate 60 and a press plate 66 which secures the PCB 13 to the interface assembly 10' to form the sandwiched testing assembly 19'. The stripper plate 60 and the press plate 66 preferably include recessed regions and/or open regions (not shown in FIG. 3) for receiving and accommodating the components 18 on the PCB 13. Although this embodiment, shows the PCB 13 with components 18 on both sides, the PCB 13 can also have components 18 on only one side. The press plate 66, PCB 13, stripper plate 60 and probe plate 22 can be held together by fasteners 80, such as screws, extending through matching fastener holes 68*a–c* in the respective plates. In one embodiment, the stripper plate is about 0.287 in. thick, the standoffs 64 are about 0.062 in. tall, the PCB 13 is about 0.110 in. thick, and the press plate 66 is about 0.500 in. thick.

Figure 4:
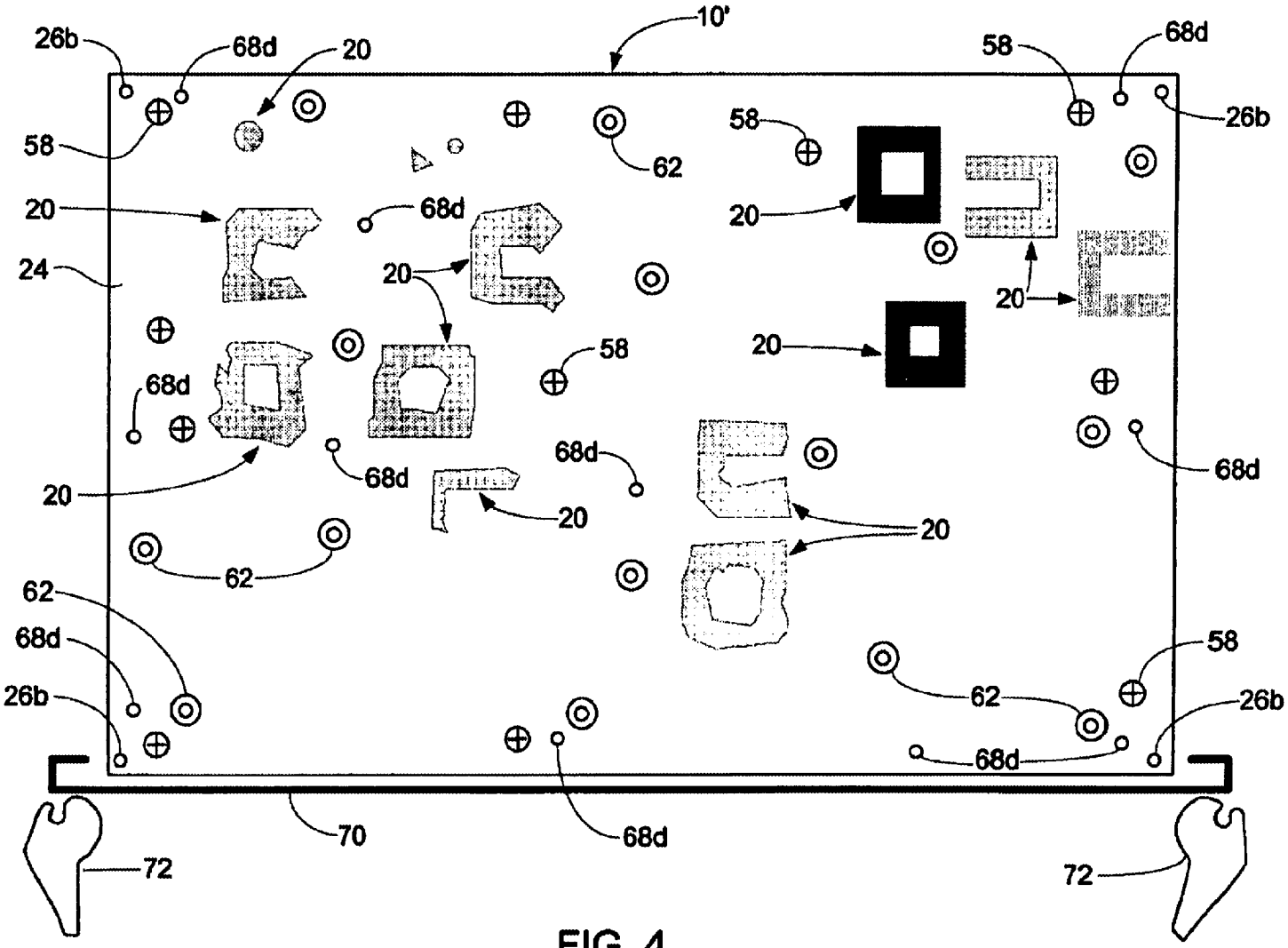
FIG. 4 is a plan view of a transfer interface in a logic analyzer interface assembly, according to one embodiment of the present invention.
Figure 5:
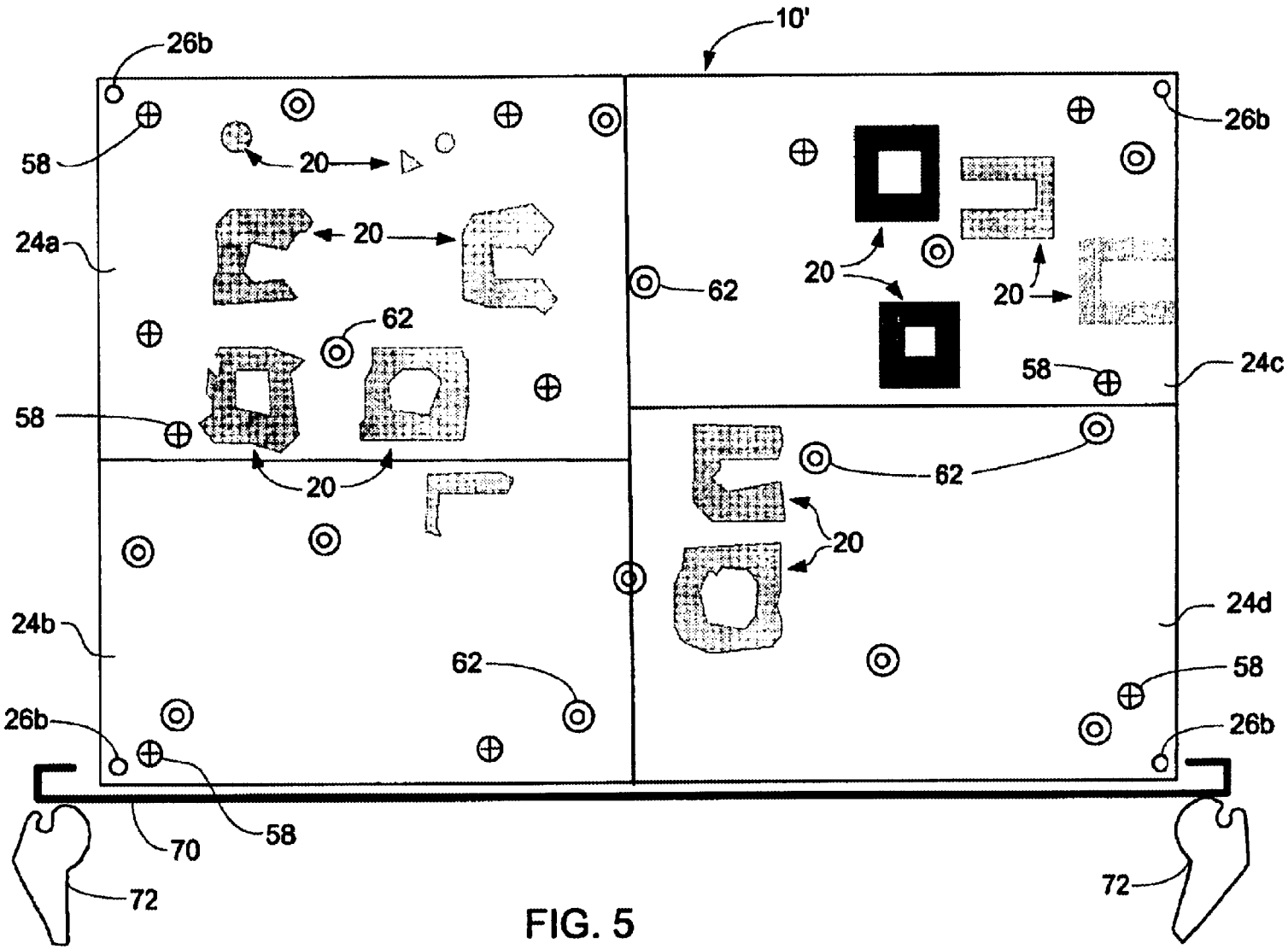
FIG. 5 is a plan view of a transfer interface in a logic analyzer interface assembly, according to another embodiment of the present invention.

As shown in FIG. 4, the probes 20 can be arranged in groups with a pattern corresponding to the pattern of the UUT contact points 36. In one example, the interface assembly 10' can include about 2700 probes 20 having a spacing of about 1 mm or less, allowing testing of a high density UUT. The embodiment shown in FIG. 4 includes a single probe retention plate 24, and all of the probes 20 extend through the single probe retention plate 24. In an alternative embodiment shown in FIG. 5, multiple probe retention plates 24*a–d* are separated into regions to retain separate groups of probes 20. Having probe retention plates 24*a–d* separated into regions facilitates removal and maintenance of selected probes 20 especially when a large number of probes are used. In the exemplary embodiment, the tooling holes 26*b* through the probe retention plate(s) 24 and probe plate 22 are located in the corners for receiving the tooling pins. Alternatively, the tooling holes 26*b* can be located away from the corners to prevent the corners from breaking off. The fasteners 58 are preferably located to avoid interference with secondary side components of the UUT 12. The springs 62 are preferably located such that equal force is distributed to effectively maintain a separation between the probe plate 22 and the stripper plate 60 in the relaxed configuration (i.e., not screwed down).

A faceplate 70 with latches 72 is preferably mounted to the interface assembly 10' for securing the interface assembly 10' in a chassis, as will be described in greater detail below.

Figure 6:
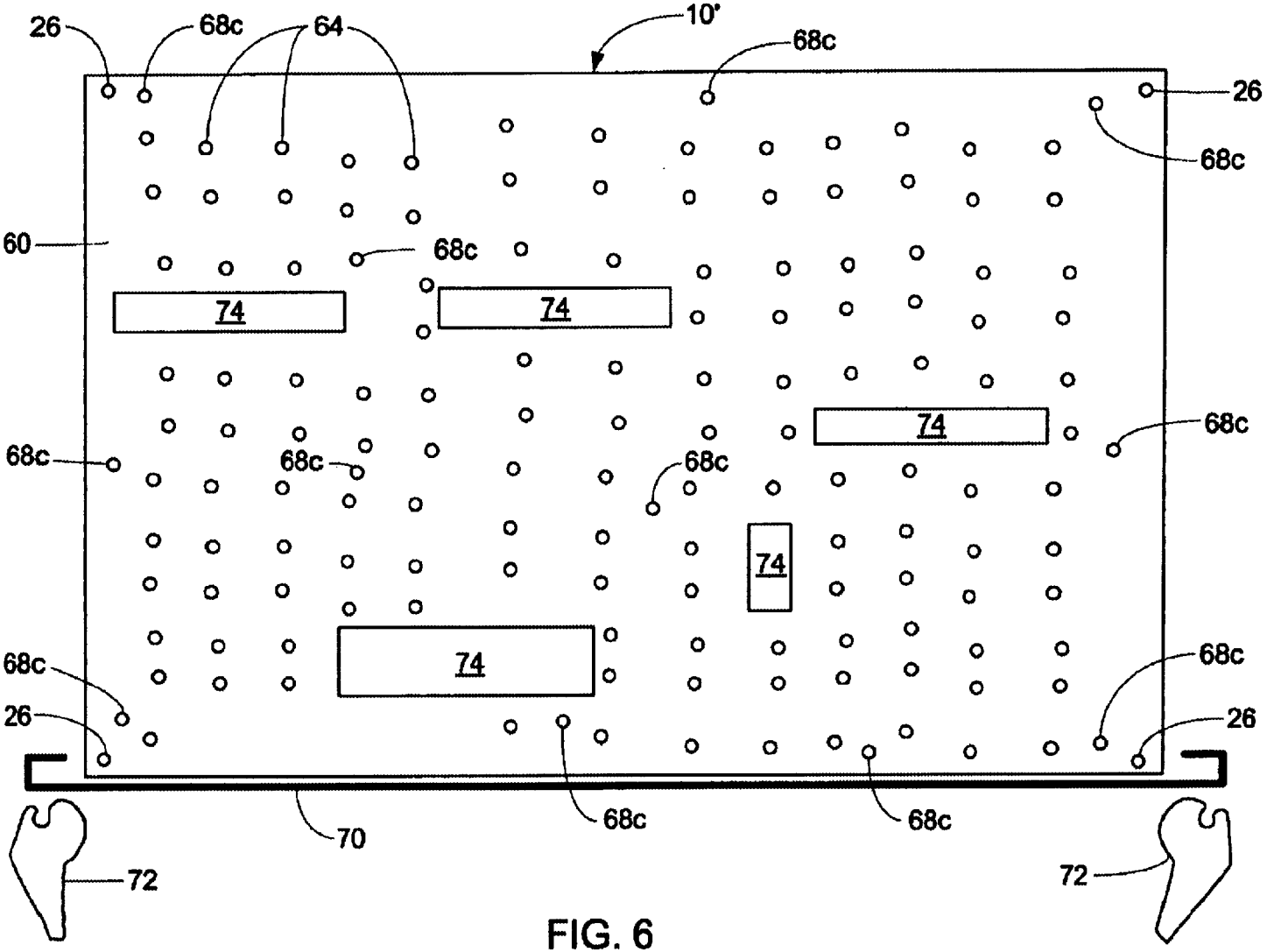
FIG. 6 is a plan view of a stripper plate in a logic analyzer interface assembly, according to one embodiment of the present invention.

As shown in FIG. 6, the standoffs 64 are preferably located on the stripper plate 60 such that the standoffs contact the PCB 13 to keep the PCB 13 flat and slightly elevated off of the stripper plate 60. This spacing allows air flow between the PCB 13 and the stripper plate 60 and around the components 18. Recessed and/or open regions 74 are formed in the stripper plate 60 in locations corresponding to the components 18 on the PCB 13.

Figure 7:
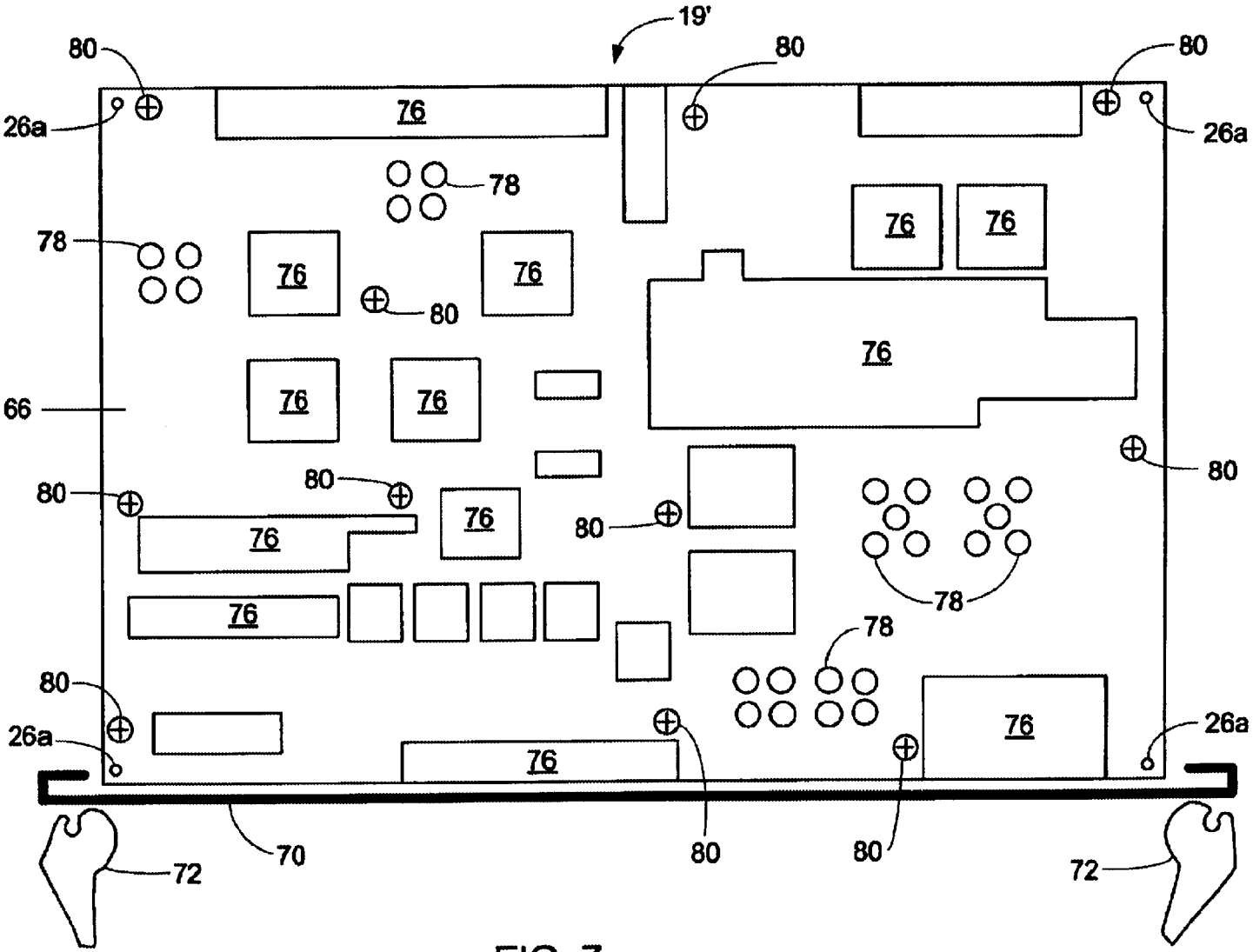
FIG. 7 is a plan view of a press plate in a logic analyzer interface assembly, according to one embodiment of the present invention.

As shown in FIG. 7, recessed and/or open regions 76 are formed in the press plate 66 in locations corresponding to the components 18 on the PCB 13. Additional holes 78 can also be formed in the press plate 66 to provide thermal relief. Fasteners 80 extend through thee fastener holes 68*a–d* to secure the press plate 66, PCB 13, stripper plate 60 and probe plate 22 together as a sandwiched testing assembly 19'. The fasteners 80 are preferably located such that the press plate 66 prevents flexing of the PCB 13 to minimize mechanical stress on the components 18.

Figure 8:
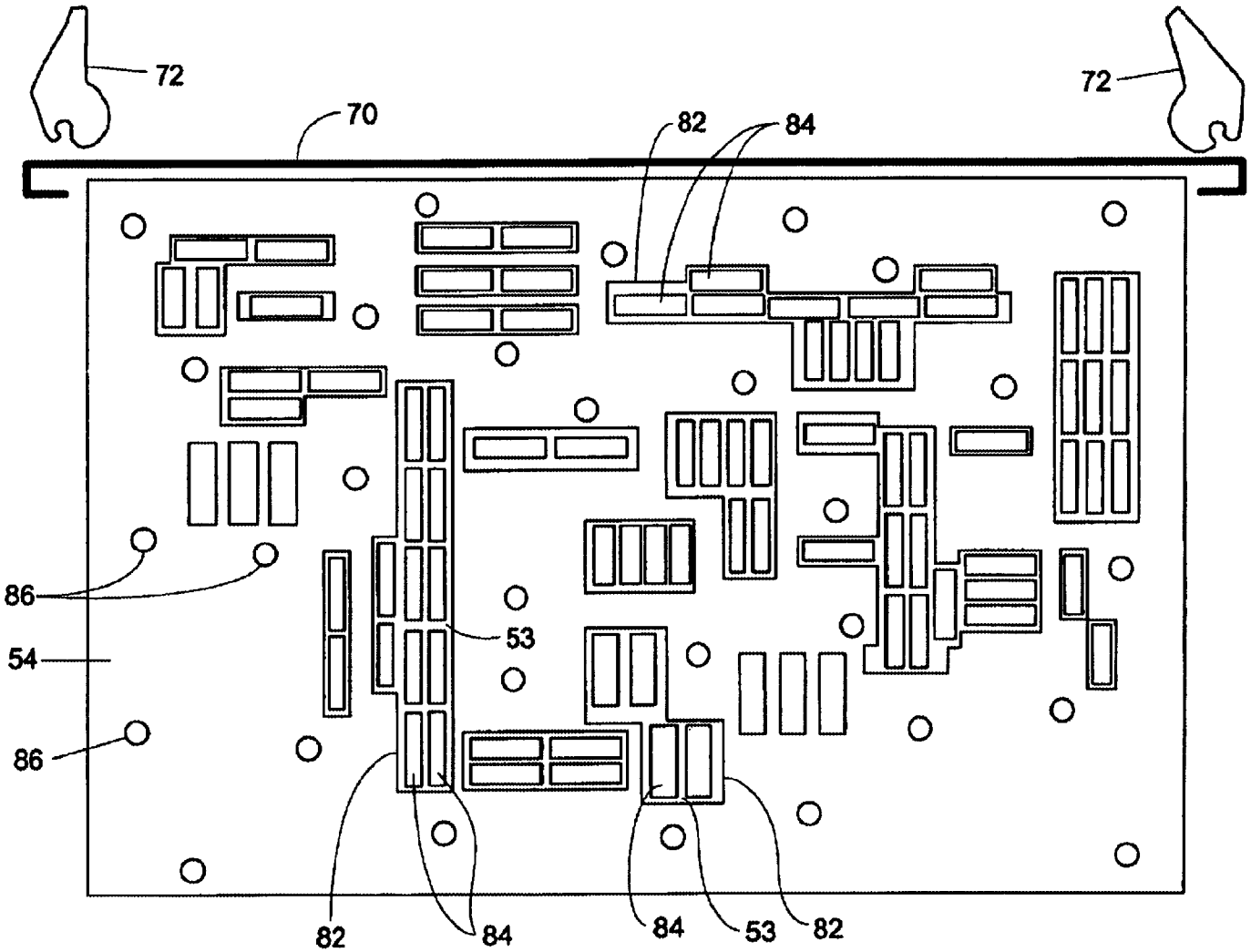
FIG. 8 is a plan view of a rail guide plate in a logic analyzer interface assembly, according to one embodiment of the present invention.

As shown in FIG. 8, the rail guide plate 54 includes open regions 82 to allow access to analyzer connectors 84 mounted on the interface board 16. Fasteners 86 extend through the rail guide plate 54 and the standoffs 56 (see FIG. 3) to secure the rail guide plate 54 to the second stiffener plate 52.

Figure 9:
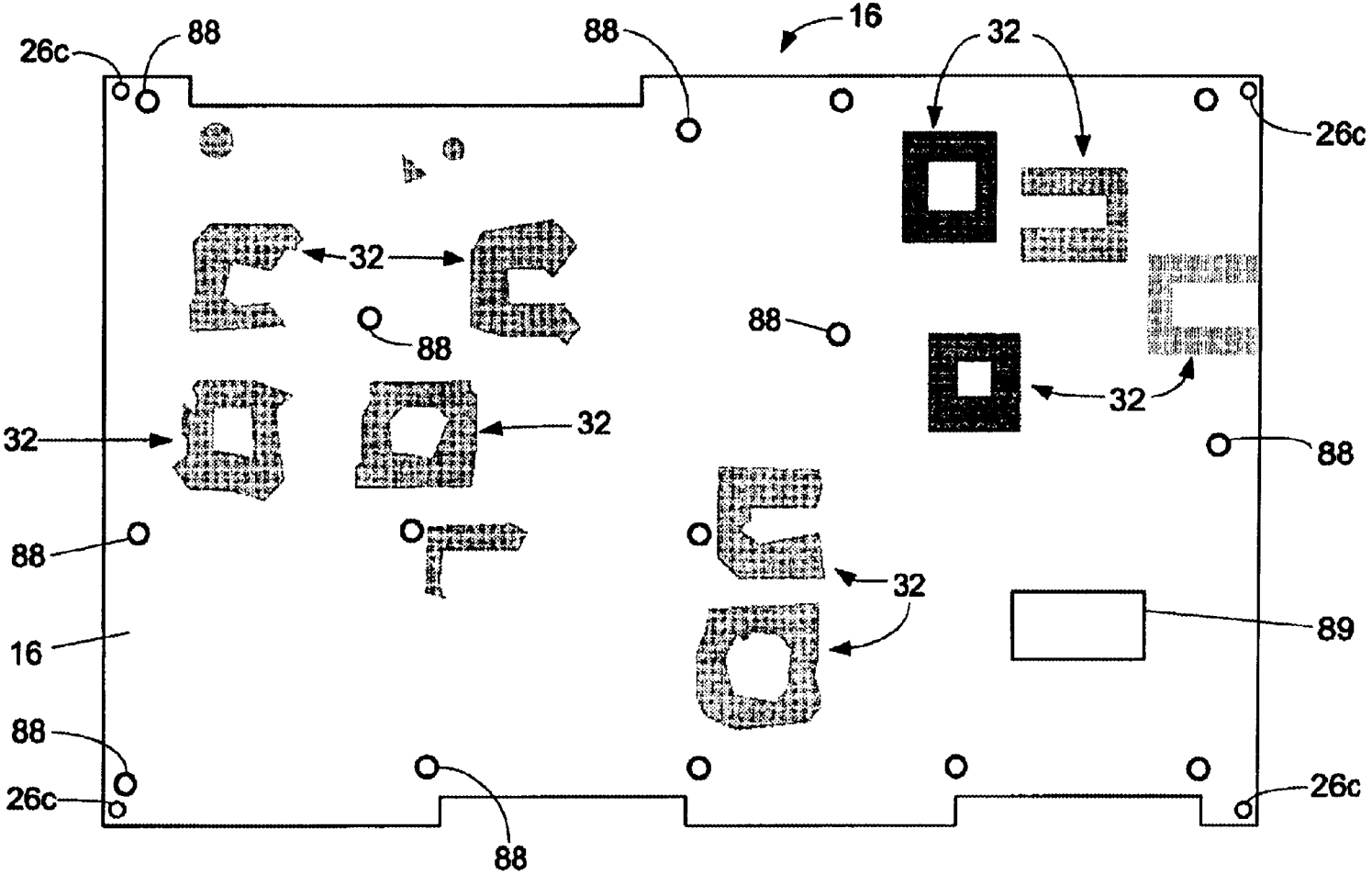
FIG. 9 is a plan view of a primary side of an interface board, according to one embodiment, of the present invention.
Figure 10:
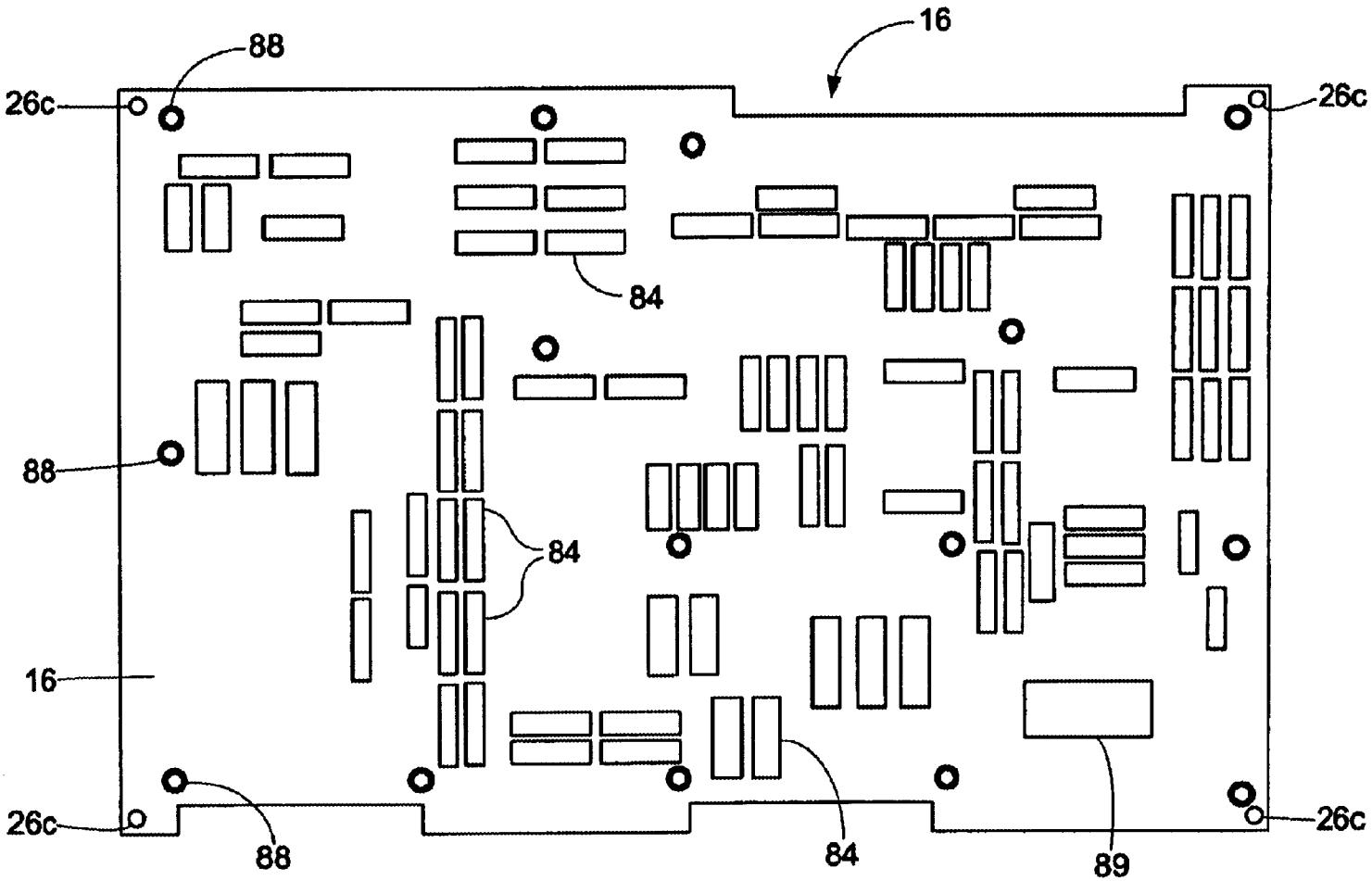
FIG. 10 is a plan view of a secondary side of the interface board shown in FIG. 9.

Referring to FIGS. 9 and 10, respectively, the primary and secondary sides of the interface board 16 are shown in greater detail. The interface contact points 32 are arranged on the primary side of the interface board 16 in groups corresponding to the pattern of the probes 20 and the UUT contact points 36 (FIG. 9). The analyzer connectors 84 are mounted on the secondary side of the interface board 16 (FIG. 10). Fastener holes 88 extend through the interface board 16 for receiving the fasteners 59 securing the interface board 16 to the probe plate 22 (see FIG. 3). The interface board 16 preferably includes extra holes 88 around the interface contact points 32 where the force of the probes 20 is more likely to cause bending of the interface board 16. The grounding of the interface board 16 is preferably the same as the PCB 13.

In another embodiment, the interface board 16 can include active circuitry 89 for running self-tests on the interface assembly 10. These self-tests can be used to diagnose faults in the interface assembly 10, for example, by identifying defective or shorted probes 20. The active circuitry 89 can be used to run self-tests in accordance with techniques and standards known to those of ordinary skill in the art, such as the JTAG standard for testing PCBs. The ability to run self-tests is especially advantageous when using a large number (e.g., over 2000) of probes.

According to one method of assembly, the probe retention plate(s) 24, the probe plate 22, the first stiffener plate 50, the interface board 16 and the second stiffener plate 52 are first assembled, for example, using fasteners 58 and 59. The stripper plate 60 is initially positioned over the springs 62 in an uncompressed position such that the tip 34 of the plunger 42 of each probe 20 does not extend beyond the top surface of the stripper plate 60 (as shown in FIG. 3). The PCB 13 is positioned on the stripper plate 60 such that the components 18 on one side of the PCB 13 are received in the matching recessed or open regions 74 in the stripper plate 60. The press plate 66 is positioned over the PCB 13 such that the components 18 on the other side of the PCB 13 are received in the matching recessed or open regions 76 in the press plate 66.

The press plate 66 is then secured or screwed down using the fasteners 80. The press plate 66 is preferably evenly screwed down by partially tightening the fasteners 80 to prevent damage to the probes. As the press plate 66 is screwed down, the stripper plate 60 compresses the springs 62 and the tip 34 of each plunger 42 extends through each probe hole in the stripper plate 60 to contact the UUT contact points 36 on he PCB 13. Thus, the stripper plate 60 ensures that the probes 20 hit the UUT contact points 36. The PCB 13 then compresses the plunger 42 of each probe 20 until the stripper plate 60, PCB 13, and press plate 66 are sandwiched. In one embodiment, the stripper plate 60 travels about 0.345 in. when compressed and the probes 20 travel about 0.116 in. when compressed.

Figure 12:
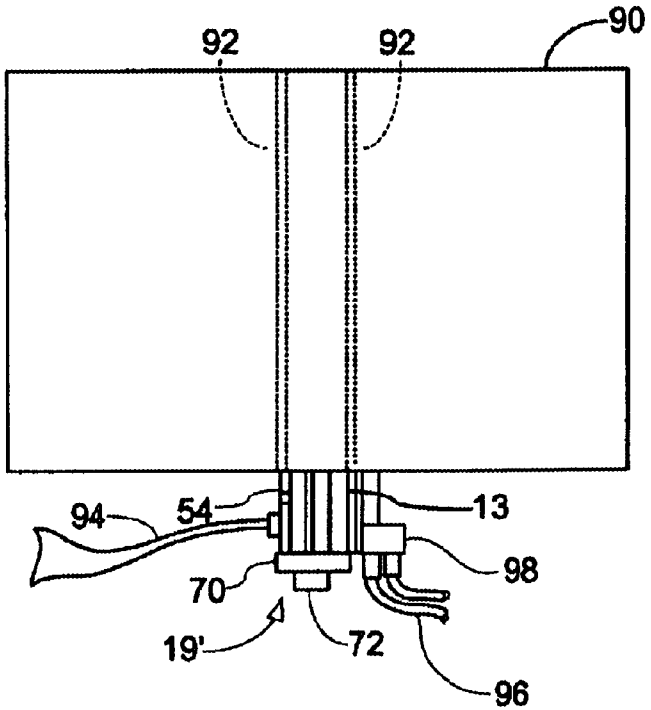
FIG. 12 is a top view of the testing configuration shown in FIG. 11 with the sandwiched testing assembly partially inserted.
Figure 11:
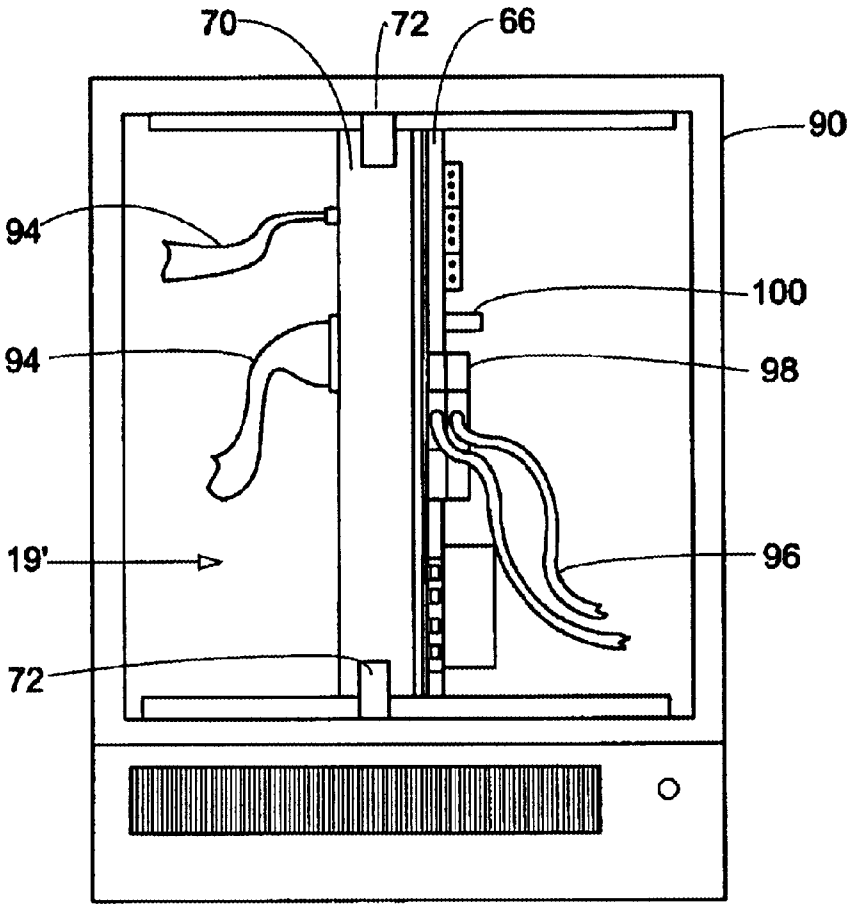
FIG. 11 is a side view of a testing configuration, according to one embodiment of the present invention.

Once assembled, as shown in FIGS. 11 and 12, the sandwiched testing assembly 19' can be inserted into a chassis 90 for conducting tests at least approaching an "at speed observation." Degradation of signal integrity because of additional connections (e.g., probe and interface board) may prevent a true "at speed" observation. The present invention, however, aids in approaching an "at speed" observation, especially when techniques are used to improve signal quality, as discussed above. The rail guide plate 54 and the PCB 13 preferably ride in card guides 92 in the chassis 90 and support the weight of the sandwiched testing assembly 19'. Analyzer cables 94 are connected to the analyzer connectors 84 through the rail guide plate 54 and media cables 96 are connected to connectors 98 mounted on the PCB 13. In one embodiment, a bracket 100 or other supporting mechanism is mounted on the press plate 66 to provide strain relief for the media cables 96 connected to the UUT or for the analyzer cables 94 connected to the interface board. To test another UUT of the same type, the press plate 66 is unscrewed, the PCB 13 is removed and the next PCB 13 is secured as described above. Thus, the interface assembly 10 can be used to test multiple UUTs with a relatively quick changeover.

Modifications and substitutions by one of ordinary skill in the art are considered to be within the scope of the present invention, which is not to be limited except by the following claims.

The invention claimed is:

1. A logic analyzer interface assembly for use with a unit under test (UUT) having a plurality of UUT contact points in a predefined pattern, said interface assembly comprising:

an interface board having a plurality of interface contact points on a primary side arranged to match said predefined pattern of said UUT contact points and a plurality of analyzer connectors on a secondary side, wherein said contact points are electrically connected to said analyzer connectors; and a transfer interface including:

at least one probe plate;

a plurality of probes extending through and floating freely in said at least one probe plate, each of said probes including a barrel and a single spring loaded plunger extending from one end of said barrel, wherein said plunger of each of said probes contacts said UUT contact points and said barrel of each of said probes contacts said interface contact points on said interface board; and at least one probe retention plate positioned over at least one side of said at least one probe plate for retaining said probes in said probe plate.

2. The logic analyzer interface assembly of claim 1 wherein said plurality of probes include over 2,000 probes.

3. The logic analyzer interface assembly of claim 1 wherein said at least one probe plate includes at least one hollow section within said probe plate.

4. The logic analyzer interface assembly of claim 1 wherein said at least one probe retention plate includes a plurality of probe retention plates, wherein each of said plurality of probe retention plates retains a respective group of probes.

5. The logic analyzer interface assembly of claim 1 wherein said interface contact points are made of gold.

6. The logic analyzer interface assembly of claim 1 wherein said interface board includes active circuitry for running self-test diagnostics on said interface assembly.

7. The logic analyzer interface assembly of claim 1, wherein said UUT contact points are located proximate a receiving end of an electrical net for input only signals and output only signals.

8. The logic analyzer interface assembly of claim 1 wherein said interface board includes an electronic component connected between said interface contact points and said analyzer connectors for improving signal quality.

9. The logic analyzer interface assembly of claim 8 wherein said electronic component includes an impedance matching component.

* * * * *